United States Patent [19]

Bonfigilioli et al.

[11] Patent Number: 5,048,756

[45] Date of Patent: Sep. 17, 1991

[54] FUEL SUPPLY CIRCUIT FOR AN ELECTROMAGNETICALLY OPERATED FUEL INJECTION VALVE OF AN INTERNAL COMBUSTION ENGINE

[75] Inventors: Silverio Bonfigilioli, Zola Predosa; Francesco Morini, Bologna, both of Italy

[73] Assignee: Weber S.r.l., Turin, Italy

[21] Appl. No.: 492,624

[22] Filed: Mar. 13, 1990

[30] Foreign Application Priority Data

Mar. 14, 1989 [IT] Italy ..... 67180 A/89

[51] Int. Cl.[5] ..... F02M 51/00

[52] U.S. Cl. ..... 239/125; 239/585

[58] Field of Search ..... 239/125, 584, 585

[56] References Cited

U.S. PATENT DOCUMENTS

| | | | |
|---|---|---|---|
| 3,731,880 | 5/1973 | Williams | 239/585 |
| 4,156,506 | 5/1979 | Locke et al. | 239/585 |
| 4,434,765 | 3/1984 | Eshelman | 239/585 X |
| 4,524,743 | 6/1985 | McAuliffe, Jr. et al. | 239/585 X |
| 4,711,397 | 12/1987 | Lahiff | 239/585 X |
| 4,722,482 | 2/1988 | Jordan et al. | 239/585 |
| 4,725,041 | 2/1988 | Chauvin et al. | 239/585 X |
| 4,971,291 | 11/1990 | Cristiani et al. | 239/585 X |
| 4,986,478 | 1/1991 | Bertini | 239/585 |

FOREIGN PATENT DOCUMENTS

| | | | |
|---|---|---|---|
| 1330181 | 9/1973 | United Kingdom | 239/585 |
| 2039993 | 8/1980 | United Kingdom . | |
| 1599525 | 10/1981 | United Kingdom . | |
| 2157761 | 10/1985 | United Kingdom . | |

*Primary Examiner*—Andres Kashnikow
*Assistant Examiner*—William Grant
*Attorney, Agent, or Firm*—Jeffers, Hoffman & Niewyk

[57] ABSTRACT

The valve comprises a casing and an injection nozzle fixed to this and provided with at least one fuel injection orifice and a shutter member movable under the action of an electromagnet and adapted to control the passage of fuel through the injection orifice, this shutter member being provided with an active surface adapted to engage on a corresponding seat of the nozzle in which the injection orifice is located; the valve is characterized by the fact that it includes passages for supplying fuel to the injection orifice from a region outside the valve, which are formed substantially in a region which is disposed peripherally around the first-defined seat and which lies substantially in a plane perpendicular to the axis of the valve and containing the seat itself.

8 Claims, 1 Drawing Sheet

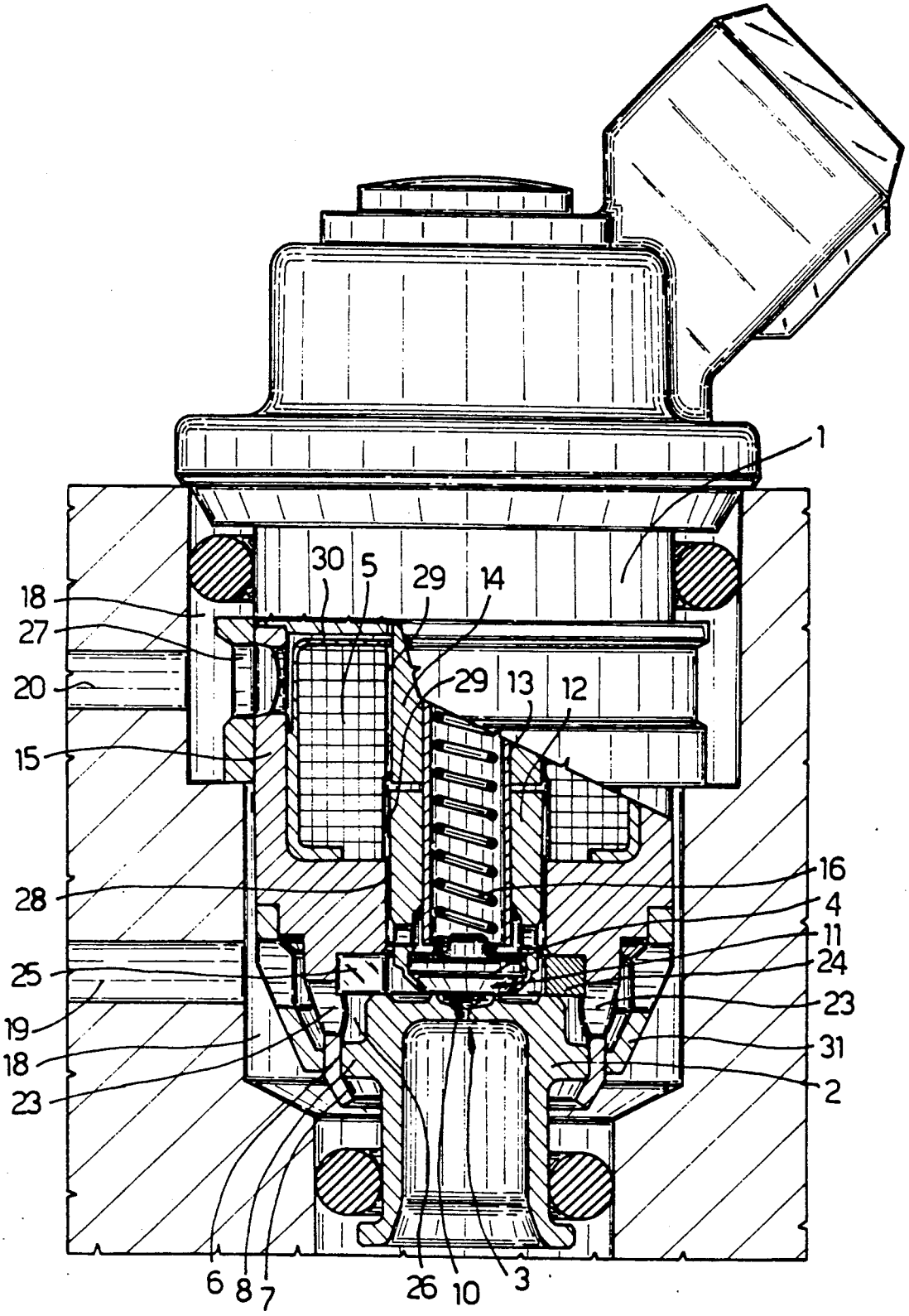
1
30
5
29
14
18
27
20
29
13
12
15
16
28
4
11
24
25
23
19
31
18
2
23
6
8
7
26
10
3

FUEL SUPPLY CIRCUIT FOR AN ELECTROMAGNETICALLY OPERATED FUEL INJECTION VALVE OF AN INTERNAL COMBUSTION ENGINE

BACKGROUND OF THE INVENTION

The present invention relates to an electromagnetically actuated fuel injection valve for an internal combustion engine and, in particular, to an improved circuit for supplying fuel to the injection orifice of the valve itself.

As is known, valves of this type substantially comprise a casing of cylindrical form, an injection nozzle fixed to the casing and provided with at least one fuel injection orifice and a shutter member movable under the action of an electromagnet which is operable to control the passage of fuel through the injection orifice.

The movable shutter member is provided with a substantially flat active surface adapted to engage a corresponding seat of the nozzle within the interior of which the injection orifice is located.

To supply fuel to the said injection orifice from a region outside the valve there is normally provided a circuit including perforations formed in the side wall of the valve casing in a region located in the upper part of the casing itself well above the said first seat. This circuit includes a series of ducts extending from suitable holes and surfaces of various members of the valve which put the said perforations into communication with the injection orifice.

The first-mentioned circuit serves, as well as to supply fuel to the injection orifice from the said region outside the valve, also to convey to this region fuel which is not injected and which therefore must be discharged from the valve itself.

Valves of the described type have various disadvantages.

First of all, when the valve is inactive, in particular when the motor vehicle on which it is mounted remains for a long period exposed to the sun, fuel vapours form within the first mentioned fuel circuit, which makes it difficult to start the engine, and which can easily result in unburnt fuel in the exhaust. In fact, the fuel duct starting from the interior of the valve has a rather great length and comprises numerous sections of short dimensions within which fuel vapours can easily arise.

Moreover, there is a pressure drop along the said duct which reduces the fuel pressure supplied to the injection orifice, and which detrimentally influences the metering and atomisation action performed by the valve.

SUMMARY OF THE INVENTION

The object of the present invention is that of providing a fuel injection valve for an internal combustion engine, of the type first described, with which the disadvantages which have been described above can be eliminated and by means of which it is possible to eliminate the formation of fuel vapours even after prolonged exposure of the motor vehicle to the sun, and which will have an entirely negligible pressure drop along the ducts which supply the fuel to the injection orifice from the region outside the valve.

This object is obtained with an electromagnetically actuated fuel injection valve for an internal combustion engine, substantially comprising a casing, an injection nozzle fixed to the casing and provided with at least one fuel injection orifice and a shutter member movable under the action of an electromagnet and adapted to control the passage of fuel through the said injection orifice, the said movable shutter member being provided with an active surface adapted to engage the corresponding seat of the said nozzle within which the said injection orifice is located, and the said valve including passages for supply of fuel to the said injection orifice from a region outside the valve, characterised by the fact that the said passages are formed substantially in a region disposed peripherally around the said seat and lying substantially in a plane perpendicular to the axis of the said valve and which contains the said seat.

BRIEF DESCRIPTION OF THE DRAWING

For a better understanding of the valve of the present invention a more detailed description thereof will now be given, by way of example, with reference to the attached drawing which is an axial section of the valve of the invention.

DETAILED DESCRIPTION OF THE INVENTION

As can be seen from the drawing, the valve of the invention comprises a substantially cylindrical casing 1 and an injection nozzle 2 fixed to the casing and provided with at least one fuel injection orifice 3 and a shutter member 4 movable axially under the action of an electromagnet 5 disposed within the casing 1.

The casing 1 includes a lower sleeve 6 the terminal edge 7 of which is plastically deformated over a collar 8 of the nozzle to fix this latter to the casing.

The shutter member 4 is provided with a substantially flat active surface 10 adapted to engage on a corresponding flat surface of the seat 11 within which the orifice 3 is located: when the shutter member 4 is in contact with the seat 11 passage of fuel through the injection orifice 3 is prevented.

The shutter member 4 is connected to a tubular armature 12 movable axially on a guide sleeve 13 fixed to a tubular core 14, in turn connected to the casing 1 of the valve.

The electromagnet 5 is coaxial with the armature 12 and with the core 14 and is disposed within a side wall 15 of the casing 1.

A coil spring 16 disposed within a guide sleeve 13 normally holds the shutter member 4 against the corresponding seat 11; this spring is interposed between this member and a stop shoulder 17 not shown in the drawing.

The valve is normally positioned within a cavity 18 into which the fuel is supplied and from which it is discharged through ducts 19 and 20 respectively.

According to the invention, to supply fuel from the cavity 18 to the injection orifice 3 there are provided passages 23 which are formed substantially in a region which is disposed peripherally around the seat 11 of the shutter member 4 and which substantially lies in a plane which is perpendicular to the axis of the valve and which contains the seat itself.

Conveniently the passages 23 are formed on the sleeve 6 immediately above the turned edge 7. Moreover, between the nozzle 2 and the casing 1 is disposed a spacer washer 24 which is provided with a radial slot 25 which is in communication with the passages 23.

Further, the valve includes an annular fuel chamber 26 into which the passages 23 open and which is interposed between these latter and the seat 11. Conveniently the annular chamber 26 is defined by the surfaces of a groove in the nozzle 2 and the lower surface of the spacer washer 24. The height, measure in the direction of the axis of the valve, of the passages 23 is conveniently greater than the height of the annular chamber 26, as is clearly seen in the drawing.

Furthermore, the valve includes passages 27 for discharging unused fuel from the valve towards the cavity 18 and towards the discharge holes 20. The passages 27 are substantially constituted by holes formed in the wall 15 of the casing 1, which are in communication with the injection orifice 3 through ducts which are defined between the various members of the valve; these ducts substantially comprise the two annular channels 28 and 29 the first of which is defined between the armature 12 and the inner surface of the electromagnet 5 and the second of which is defined between the core 14 and the same surface; the first-defined duct further includes the annular chamber 30 which is located above the electromagnet 5.

The valve also includes a filter 31 of annular form provided with radial inlet holes; other constructional details of the valve, well known per se, are readily seen from the section of the drawing.

The operation of the valve described is as follows.

As soon as the electromagnet 5 is excited the armature 12, attracted by the core 14, is displaced upwardly spacing the shutter member 4 from the corresponding seat 11: in this way a predetermined quantity of fuel is injected through the injection orifice 3: this latter arrives at this orifice through the duct which is formed by the passages 23, the annular chamber 26 and the slot 25 formed in the washer 24. This duct therefore allows a flow of fuel which moves in a region which is disposed peripherally around the seat 11 and which substantially lies in a plane perpendicular to the axis of the valve and which contains the seat itself.

Because of the form of this duct and its short length the pressure of fuel at the injection orifice 3 is substantially the same as that within the cavity 18 outside the valve: the pressure drop in the fuel upon passing from the cavity to the injection orifice is therefore entirely negligible and thus the metering action and the atomisation of the valve is very effective.

During the operating period of the valve immediately after a period of inactivity of the valve itself in which the vehicle has been exposed to the sun (and therefore when the fuel contained within the valve is at a very high temperature) the flow of fuel which enters through the passage 23 performs an effective washing action to convey any possible fuel vapours which have formed within the valve itself towards the discharge passages 27 and therefore towards the discharge duct 20. In fact the fuel and the associated vapours which are contained in the annular channels 28 and 29 and in the annular chamber 30 move together towards the passages 27, whilst the fresh fuel which enters through the passages 23 is supplied directly to the injection orifice 3. The high capacity of the annular chamber 26 avoids the formation of fuel vapours in it and therefore the flow of fuel which comes from the cavity 18 through the passages 23 is substantially free from vapour bubbles.

It has been found that the washing action which can be obtained with the valve of the invention is very effective in low pressure fuel circuits; therefore this valve is particularly suitable for such circuits.

Consequently, therefore, even in the first operating period of the valve correct quantities of fuel are injected through the injection orifice 3 and therefore no starting difficulties are caused nor is there any formation of unburnt fuels in the exhaust.

The valve of the invention can also be mounted in a cavity 18 the fuel supply duct 19 and discharge duct 20 of which are differently disposed. In particular the axis of the discharge hole 20 can be disposed in the same plane orthogonal to the axis of the valve in which the axis of the hole 19 is contained and on the opposite side from this latter.

It is clear that the form and arrangement of the various parts of the injection valve which has been described can have modifications and variations introduced thereto without departing from the ambit of the invention.

We claim:

1. An electromagnetically operated fuel injection valve for an internal combustion engine, said valve comprising a casing, an injection nozzle fixed to said casing and provided with at least one fuel injection orifice and a shutter member movable under the action of an electromagnet and adapted to control the passage of fuel through said injection orifice, said movable shutter member being provided with an active surface adapted to engage a corresponding seat of said nozzle within the interior of which said injection orifice is located, and said valve including passages for supplying fuel to said injection orifice from a region outside said valve, said passages being formed substantially in a region disposed peripherally around said seat and lying substantially in a plane perpendicular to the axis of said valve and which contains said seat, said valve further including a spacer washer disposed between said nozzle and said casing, said spacer washer being disposed peripherally around said shutter member and including a through aperture in communication with said passages.

2. The valve of claim 1 wherein said passages are formed in the lower part of said casing which is contiguous with said nozzle.

3. The valve of claim 2 wherein said casing includes a sleeve projecting from said lower part and provided with an edge turned in, by plastic deformation, onto a collar of said nozzle, and said passages are formed on said sleeve immediately above said turned edge.

4. The valve of claim 1 wherein said through aperture of said spacer washer is a radial slot in communication with said passages.

5. The valve of claim 1 further including an annular fuel chamber into which said passages open and which is interposed between said passages and said seat.

6. The valve of claim 5 wherein said annular chamber is defined by the surfaces of a groove in said nozzle and by the lower surface of said spacer washer.

7. The valve of claim 5 wherein the height of said passages, measured in the direction of the axis of said valve, is greater than the height of said annular chamber.

8. The valve of claim 1 further including second passages for conveying fuel from the region close to said injection orifice towards said region outside said valve, said second passages including at least one perforation formed in said casing in a region located above said passages to supply fuel to said injection orifice.

* * * * *